US005448212A

United States Patent [19]

Ohtsu et al.

[11] Patent Number: 5,448,212

[45] Date of Patent: Sep. 5, 1995

[54] DEFLECTION YOKE DEVICE

[75] Inventors: Shinji Ohtsu; Tsunehiko Katano; Sachihito Nakafuku, all of Nagaokakyo, Japan

[73] Assignee: Murata Mfg. Co., Ltd., Kyoto, Japan

[21] Appl. No.: 171,827

[22] Filed: Dec. 22, 1993

[30] Foreign Application Priority Data

Dec. 30, 1992 [JP] Japan ..... 4-093801 U

[51] Int. Cl.[6] ..... H01F 5/02

[52] U.S. Cl. ..... 335/214; 315/8

[58] Field of Search ..... 335/210–214; 313/440; 315/8

[56] References Cited

U.S. PATENT DOCUMENTS

| | | | |
|---|---|---|---|
| 4,709,220 | 11/1987 | Sakane et al. | 335/214 |
| 4,853,588 | 8/1989 | Ohtsu et al. | 313/440 |
| 5,036,246 | 7/1991 | Germani | 313/440 |
| 5,049,847 | 9/1991 | Okuyama et al. | 225/214 |
| 5,124,613 | 6/1992 | Park et al. | 313/440 |
| 5,157,305 | 10/1992 | Satoh et al. | 315/370 |
| 5,189,348 | 2/1993 | Yokota et al. | 315/399 |
| 5,191,307 | 3/1993 | Hashimoto et al. | 335/214 |
| 5,220,241 | 6/1993 | Kanazawa et al. | 313/440 |

*Primary Examiner*—Leo P. Picard
*Assistant Examiner*—Raymond M. Barrera
*Attorney, Agent, or Firm*—Rogers, Howell & Haferkamp

[57] ABSTRACT

A deflection yoke device of the present invention includes a unit bobbin to be mounted in such a manner as to be fitted in a head portion side of a deflection yoke bobbin. The unit bobbin has two coil winding portions disposed at either or both of top and bottom sides of the deflection yoke so that magnetic leakage-protecting coils can be formed by directly winding a wire around the coil winding portions. The unit bobbin further includes terminals for fixing lead wires extracted from the magnetic leakage-protecting coils.

4 Claims, 3 Drawing Sheets

DEFLECTION YOKE DEVICE

BACKGROUND OF THE INVENTION

1. Field of the Invention

The present invention relates to a deflection yoke device, and in particular to a deflection yoke device equipped with magnetic leakage-protecting coils.

2. Description of the Prior Art

Recent studies indicate that magnetic leakage from a cathode ray tube of a deflection yoke in a television receiver set or display apparatus adversely affects the human body, especially pregnant women. Attempting to address this problem, some protective measures have been taken to minimize the magnetic leakage from the deflection yoke. FIG. 1A is a deflection yoke device equipped with magnetic leakage-protecting coils which protect against magnetic leakage.

A magnetic leakage protecting coil 12 shown in FIG. 1A is formed such that, as shown in FIG. 1B, an adhesive-coated copper wire 1, which is coated with an adhesive layer made of a thermoplastic resin or the like, is wound ring-wise forming a coil. The coiled wire is then current-heated so as to melt the adhesive layer thereby forming an integrally united coil made of plural coiling rings. The united coil is fitted in a coil bobbin 2 as shown in FIG. 1C to complete the magnetic leakage protecting coil 12. Alternatively, the coil 12 may be composed of a square or ring-shaped bobbin which is formed in advance with a wire wound thereon by a flyer method. Lead wires extracted from the coil 12 are drawn outside from the coil bobbin 2 as shown in FIG. 1D. These lead wires are cut to a desired length for connection. The distal end portions required for soldering are abraded or processed in another way for terminal treatment while the other portion is covered by an insulating tube 3.

A couple of the thus formed magnetic leakage-protecting coils 12 are mounted to a bobbin portion 11 of a deflection yoke 5 by snap-mounting means, adhesive means or any other engaging means. One coil is mounted at a top side and the other at a bottom side of an enlarged diameter portion 4 of a head portion 9 of the bobbin 11. Further, a printed wiring board 6, having an appropriate number of connect pins 7 ,are located on a neck portion of the deflection coil 5. The pins 7 are twined and soldered with lead lines extracted from the coils 12 to thereby complete a deflection yoke device in which the coil of the deflection yoke 5 is connected with the magnetic leakage-protecting coils 12.

However, in the prior art example described above, complicated, manual assembling is required which comprises the steps of fitting the wound coils in the coil bobbins 2, cutting the lead wires of the coils to a predetermined length, treating the ends of the wires, covering each of the extracted lead wires with the tube 3 and twining the wires with respective pins 7 so that the wires may be soldered to the pins 7. Further, because the two magnetic field leakage protecting coils 12 are manually connected with each other through the pins 7 disposed on the deflection yoke 5, this structure allows mis-connection between the two coils 12.

SUMMARY OF THE INVENTION

The present invention has been achieved to solve the problems described above, and it is therefore an object of the present invention to provide a deflection yoke device which requires no complicated assembling of magnetic leakage-protecting coils and which reduces the risk of mis-connection.

In one embodiment of the present invention, a deflection yoke device includes a unit bobbin mounted on a head portion of a deflection yoke bobbin, the unit bobbin comprises: at least one coil winding portion disposed at either, or both, the top or bottom side of the deflection yoke so that magnetic leakage-protecting coils(s) can be formed by directly winding a wire around the coil winding portion; and terminals for fixing lead wires extracted from the magnetic leakage-protecting coil(s).

In the deflection yoke device of the present invention, two magnetic leakage-prospecting coils, for example, are formed by winding the coil-winding wire around each of the coil-winding portions disposed at the top and bottom sides of the deflection yoke, and the two coils formed in respective winding portions are connected with one another by twining the lead wires on the terminals disposed on the common unit bobbin. Thus, the formation of the magnetic leakage-protecting coils and the connection of these coils can be completed on the unit bobbin. The bobbin with the magnetic leakage-protecting coils is snap-mounted easily to the head side of the deflection yoke, thereby canceling the leakage magnetic fields by the magnetic fields produced by the magnetic leakage-protecting coils.

In accordance with the present invention, since the coil-winding portions for forming the magnetic leakage-protecting coils as well as terminals for fixing lead wires extracted from the same coils are provided on the unit bobbin, it is possible to perform the coil-winding step and the wire connection step, for forming the magnetic leakage-protecting coils, in sequential mechanical steps. Accordingly, it is no longer necessary to carry out the complicated, manual operations conventionally required for assembling magnetic leakage protection coils comprising the steps of forming coils by winding wires; accommodating the coils in respective coil bobbins; covering lead wires with tubes; and twining ends of the wires on pins to facilitate soldering. As a result, the assembling operation can be automated thus achieving improved operation efficiency.

Additionally, when a couple of the magnetic leakage-protecting coils are provided on the top and bottom sides of the deflection yoke, these magnetic leakage-protecting coils are formed in respective coil-winding portions on the unit bobbin and both the coils are connected to the terminals on the same unit bobbin. As a result, because the formation of both coils and the connection of wires is effected on the common unit bobbin in sequential steps, the likelihood of mis-connection is greatly reduced.

In the conventional magnetic leakage-protecting coil, it was necessary to use the adhesive-coated copper wire in order to maintain the shape of the coil. In contrast, in forming the magnetic leakage-protecting coil according to the present invention, it is possible to form the magnetic leakage-protecting coils integrally with the unit bobbin by merely winding the wire with the wire being stretched with pulling force. It is no longer necessity to extract the formed coils from the winding frame one by one, and this method allows the shape of the coils to be maintained without deformation. Accordingly, typical enameled wires and the like can be used for production of the coils thereby reducing the cost of manufacturing the deflection yoke devices equipped with magnetic leakage-protecting coils.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF PREFERRED EMBODIMENT

Figure 1A:
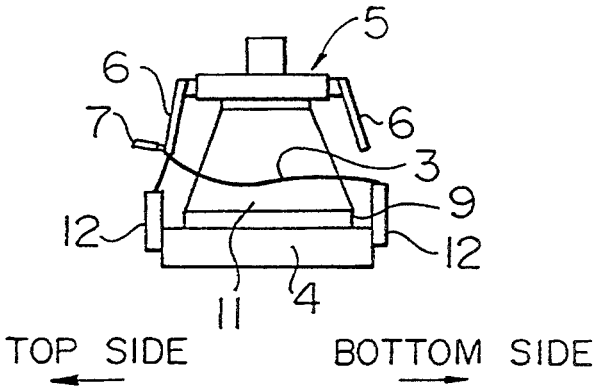
FIG. 1A PRIOR ART
FIG. 1A is a schematic illustrative view showing a deflection yoke device with prior art magnetic leakage-protecting coils attached in position.
Figure 1B:
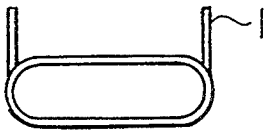
FIG. 1B PRIOR ART
FIG. 1B is a schematic plan view showing a coil-wound; wire of a prior art magnetic leakage-protecting coil.
Figure 1C:
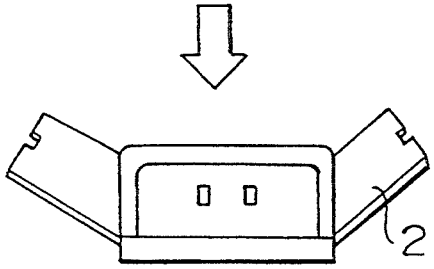
FIG. 1C PRIOR ART
FIG. 1C is a perspective view showing a coil bobbin used to wind the coil shown in FIG. 1B.
Figure 1D:
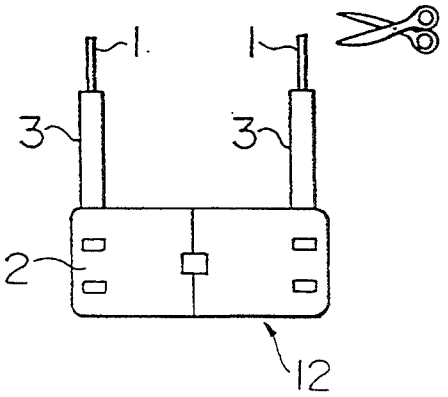
FIG. 1D PRIOR ART
FIG. 1D is a schematic plan view showing a prior art magnetic leakage-protecting coil.

Preferred embodiments of the present invention will hereinafter be described with reference to the accompanying drawings. In the description of the embodiment of the present invention, the same components as in the prior art will be allotted with the same reference numerals and repeated description of such components will be omitted.

Figure 2A:
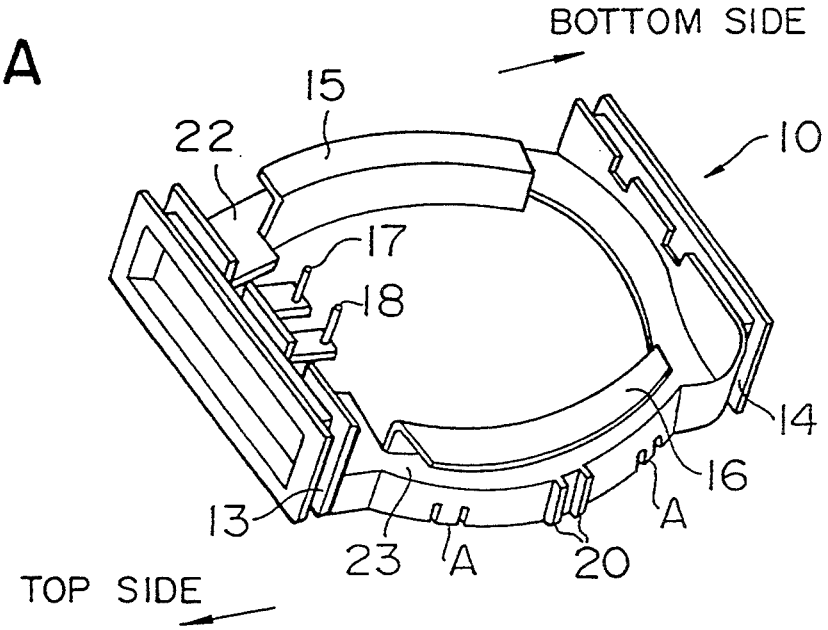
FIGS. 2A and 2B are schematic perspective views showing a unit bobbin for a magnetic leakage-protecting coil of the present invention.
Figure 2B:
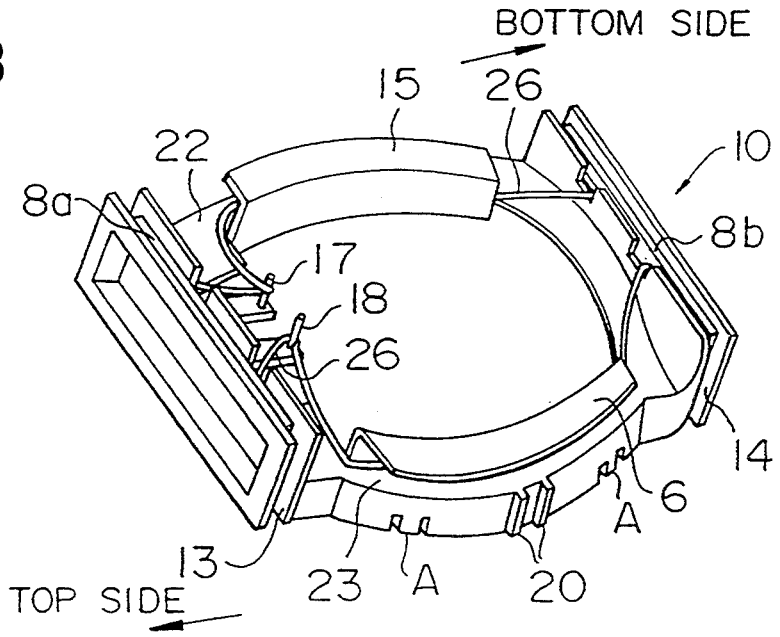

A deflection yoke of a deflection yoke device of the present embodiment is composed of the same components as described in the prior art example. FIGS. 2A and 2B show a typical unit bobbin of the present embodiment, adapted for mounting to an enlarged diameter portion of the deflection yoke.

Figure 3:
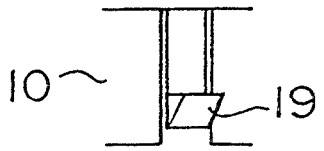
FIG. 3 is an illustrative view showing a claw shape on a rear side a clamping portion A in the unit bobbin shown in FIGS. 2A and 2B.
Figure 4:
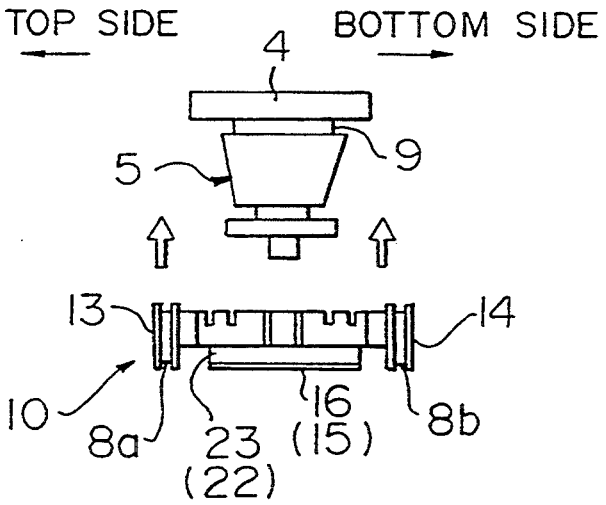
FIG. 4 is a side elevation view showing a situation of mounting an unit bobbin of the present invention to a deflection yoke.

Referring to FIG. 2A, a unit bobbin 10 includes a pair of connecting passages 22 and 23 which are arranged in parallel with each other. The unit bobbin 10 further includes a pair of rectangular-shaped coil-winding portions 13 and 14 respectively located at a top side and a bottom side of the deflection yoke. In the vicinity of the coil-winding portion 13, preferably at the top side thereof, is a pair of terminals 17 and 18 to which the lead wires extracted from the coil are fixed. Respectively formed along the aforementioned connecting passage 22 and 23 are guide pieces 15 and 16 for guiding coiling wires. On each side surface of the connecting passages 22 and 23, there is formed a rib-like jig attachment 20 for fixing the unit bobbin 10 to a wire winding machine (not shown). The unit bobbin 10 has four snap-mounting portions A, preferably formed as shown in FIG. 4, for fixing itself to the enlarged diameter portion 4 (the head side) of the deflection yoke 5. Each of the snap-mounting portions A have a claw 19 formed on the rear side thereof as shown in FIG. 3. This claw 19 is inserted into a corresponding claw-receiver disposed in the deflection yoke 5 so that the unit bobbin 10 is mounted to the deflection yoke 5.

Next, working operation of assembling magnetic leakage-protecting coils **8*a* and 8*b* will be described using the thus constructed unit bobbin 10. As shown in FIG. 2B, first, one end of a coil-winding wire 26 is twined to the terminal 17. The coil-winding wire 26 is then wound around the coil-winding portion 13 so as to create a top side magnetic leakage-protecting coil 8*a*. The coil-winding wire 26 is then twined to the terminal 18. The coil-winding wire 26 further is stretched across the connecting passage 23 to the bottom side while being guided by the guide piece 16. The coil-winding wire 26 is then wound around the coil-winding portion 14 on the bottom side to form a bottom side magnetic leakage-protecting coil 8*b*. Next, the coil-winding wire 26 is stretched across the connecting passage while being guided by the guide piece 15. Finally, the end of the coil-winding wire 26 is twined on the terminal 17 to thereby complete the magnetic leakage-protecting coil 8*a* and 8*b* connected in series on the unit bobbin 10**.

These operations, e.g., twining operation of the coil-winding wire 26 at terminals 17 and 18 and the coil-winding operation are all affected automatically, mechanically, with the unit bobbin 10 being secured to the coil-winding machine with the help of the jig attachments 20. The operation procedures of coil-winding and the number of coiling windings in each of coil winding portions 13 and 14 are all carried out by a programmed automatic control.

The thus constructed unit bobbin 10 with two magnetic leakage-protecting coils **8*a* and 8*b* disposed respectively at the top and bottom sides thereof is mounted to the deflection yoke 5 by using the claws 19 of snap-mounting portions A as shown in FIG. 4**, whereby a deflection yoke device equipped with magnetic leakage-protecting coils is completed.

According to the present embodiment, it is no longer necessary to perform the manual operations conventionally required for assembling magnetic leakage protection coils comprising the steps of: winding the adhesive-coated copper wire 1 in a coil form; solidifying the wound coil to form a one-body structure to be accommodated in the coil bobbin 2; cutting the lead wires to a desired length and subjecting them to terminal treatment; covering the wires with the tubes 3; and twining the ends of the wires on the pin 7 so as to fix the coil with solder. Furthermore, the winding of coil-winding wire 26 for forming the magnetic leakage-protecting coils **8*a* and 8*b*, as well as the twining operation of the lead wires on the terminals 17 and 18**, may be performed mechanically and automatically thus achieving an improved operation efficiency.

Additionally, the magnetic leakage-protecting coils **8*a* and 8*b* formed respectively on the top and bottom sides are formed on the unit bobbin 10 in sequential steps, so that it is no longer needed to make a connection between the magnetic leakage-protecting coils 12** at the top and bottom sides. Accordingly, the likelihood of mis-connection of the wires is greatly reduced.

Further, the number of coil-windings for each magnetic leakage-protecting coil **8*a* and 8*b*** can be automatically controlled. Therefore the number of coil-windings can be easily modified.

In the magnetic leakage-protecting coil 12 of the conventional example, it was necessary to use the adhesive-coated copper wire 1 in order to maintain the shape of the coil 12. In contrast to this, in the present embodiment the coil-winding wire 26 is wound while being stretched to form the magnetic leakage-protecting coils 8*a* and 8*b*, and the lead wire of the coil-winding wire 26 is fixed at the terminal 17 or 18. Therefore, it is not necessary to extract the formed coil from the winding frame, and the shape of the coils 8a and 8b can be maintained without deformation. Accordingly, there is no need to use the adhesive-coated copper wire for the coil-winding wire 26, and the typical enameled wires and the like may be used thereby reducing the cost of manufacturing the deflection yoke device equipped with magnetic leakage-protecting coils.

It is noted that the present invention should not be limited to the above embodiment, and various features can be adopted. For example, although the magnetic leakage-protecting coils 8*a* and 8*b* are joined in series in the above embodiment, these coils may be connected in parallel.

Additionally, although in the above embodiment the magnetic leakage-protecting coils 8a and 8b are formed at the top and bottom sides of the deflection yoke 5, it is possible to provide a coil on only one of the sides. In this case, the unit bobbin 10 in the above embodiment may be used, but use can be made of a unit bobbin 10 having only one of the coil-winding portions 13 and 14.

Figure 5A:
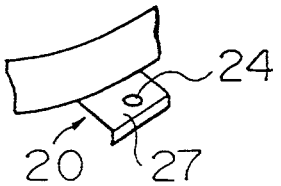
FIGS. 5A and 5B are perspective views showing other features of a jig attachment portion in a unit bobbin of the present invention.
Figure 5B:
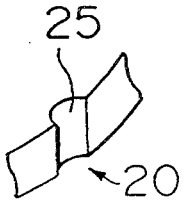

Further, although the jig attachment 20 is formed in the rib-form, it is also possible to use a plate piece 27 with an attachment hole 24 as shown in FIG. 5A or a structure having an attachment recess 25 as shown in FIG. 5B.

Moreover, although the coils 8*a* and 8*b* are produced in a rectangular form as shown in FIGS. 2A and 2B by winding the coil-winding wire around each of the coil-winding portions 13 and 14, the coils can be made in another form as long as it is ring-shaped. In such a case, the coil-winding portions 13 and 14 are formed so as to correspond to the shape of the coils to be made.

We claim:

1. A deflection yoke having magnetic leakage protection, said deflection yoke comprising:

a yoke bobbin, and a unit bobbin separable from said yoke bobbin, said unit bobbin including a plurality of winding portions, at least one connecting passage such that a plurality of magnetic leakage protection coils wound around said winding portions may be electrically connected by extending a wire across said connecting passage, and a continuous wire wound around said plurality of winding portions and extended across said at least one connecting passage to thereby form said plurality of magnetic leakage protection coils.

2. The device of claim 1 wherein said unit bobbin further includes at least one guide piece adjacent said connecting passage to thereby retain said single wire in said at least one connecting passage as said wire extends through said connecting passage.

3. The device of claim 2 wherein said plurality of winding portions comprise a pair of winding portions positioned opposite one another.

4. The device of claim 3 wherein said at least one connecting passage comprises a pair of connecting passages positioned opposite one another.

* * * * *